US009926826B2

(12) United States Patent
Umemoto et al.

(10) Patent No.: US 9,926,826 B2
(45) Date of Patent: Mar. 27, 2018

(54) INTERNAL COMBUSTION ENGINE

(71) Applicant: TOYOTA JIDOSHA KABUSHIKI KAISHA, Toyota-shi, Aichi-ken (JP)

(72) Inventors: Kazuhiro Umemoto, Susono (JP); Kohei Yoshida, Gotenba (JP); Yuki Bisaiji, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 14/914,784

(22) PCT Filed: Aug. 14, 2014

(86) PCT No.: PCT/JP2014/071816

§ 371 (c)(1),
(2) Date: Feb. 26, 2016

(87) PCT Pub. No.: WO2015/037405

PCT Pub. Date: Mar. 19, 2015

(65) Prior Publication Data

US 2016/0281573 A1 Sep. 29, 2016

(30) Foreign Application Priority Data

Sep. 12, 2013 (JP) ..... 2013-189627

(51) Int. Cl.
*F01N 9/00* (2006.01)
*F01N 3/08* (2006.01)
(Continued)

(52) U.S. Cl.
CPC ..... *F01N 9/002* (2013.01); *F01N 3/0814* (2013.01); *F01N 3/206* (2013.01); *F02M 26/04* (2016.02);
(Continued)

(58) Field of Classification Search
CPC ..... F02M 26/04; F02M 26/32; F01N 3/204; F01N 2430/06; F01N 2610/03; F01N 2610/146; F01N 2610/1493
See application file for complete search history.

(56) References Cited

U.S. PATENT DOCUMENTS 4,853,720 A * 8/1989 Onari ..... B60K 31/0008 123/350
2007/0277509 A1* 12/2007 Tahara ..... F01N 3/0253 60/286
(Continued)

FOREIGN PATENT DOCUMENTS

EP 1 331 373 A2 7/2003
EP 1331373 A2 * 7/2003 ..... B01D 53/9431
(Continued)

*Primary Examiner* — Patrick Maines
(74) *Attorney, Agent, or Firm* — Finnegan, Henderson, Farabow, Garrett & Dunner, LLP

(57) ABSTRACT

An internal combustion engine is provided with a hydrocarbon feed valve arranged in an engine exhaust passage. When injection control for injecting hydrocarbons from the hydrocarbon feed valve for exhaust treatment is stopped, to prevent the hydrocarbon feed valve from clogging, hydrocarbons for preventing clogging are injected from the hydrocarbon feed valve when the engine is not discharging soot, that is, when the feed of fuel to the inside of the combustion chamber is stopped and, after hydrocarbons for preventing clogging are injected once, the injection of hydrocarbons for preventing clogging from the hydrocarbon feed valve is stopped until injection control for exhaust treatment is started.

2 Claims, 7 Drawing Sheets

(51) Int. Cl.
*F02M 26/04* (2016.01)
*F02M 26/32* (2016.01)
*F01N 3/20* (2006.01)

(52) U.S. Cl.
CPC ..... *F02M 26/32* (2016.02); *F01N 2430/06* (2013.01); *F01N 2610/03* (2013.01); *F01N 2610/146* (2013.01); *F01N 2610/1493* (2013.01)

(56) References Cited

U.S. PATENT DOCUMENTS

| | | | | |
|---|---|---|---|---|
| 2009/0151332 | A1 | 6/2009 | Toshioka et al. | |
| 2010/0229534 | A1 * | 9/2010 | Matsunaga | F01N 3/0842 60/274 |

FOREIGN PATENT DOCUMENTS

| | | | | |
|---|---|---|---|---|
| EP | 2441934 | A2 * | 4/2012 | F01N 3/0253 |
| EP | 2 599 973 | A1 | 6/2013 | |
| JP | 2005-106047 | | 4/2005 | |
| JP | 2005106047 | A * | 4/2005 | |
| JP | 2009-270567 | | 11/2009 | |
| JP | 2009270567 | A * | 11/2009 | F01N 3/208 |
| JP | 2011-220284 | | 11/2011 | |
| WO | WO 2009/053806 | A2 | 4/2009 | |
| WO | WO 2011/162698 | A1 | 12/2011 | |

* cited by examiner

INTERNAL COMBUSTION ENGINE

CROSS-REFERENCE TO RELATED APPLICATIONS

This application is a national phase application of International Application No. PCT/JP2014/071816, filed Aug. 14, 2014, and claims the priority of Japanese Application No. 2013-189627, filed Sep. 12, 2013, the content of both of which is incorporated herein by reference.

TECHNICAL FIELD

The present invention relates to an internal combustion engine.

BACKGROUND ART

Known in the art is an internal combustion engine in which an NOx purification catalyst is arranged in an engine exhaust passage, a reducing agent feed valve for feeding a reducing agent upstream of the $NO_X$ purification catalyst is arranged in the engine exhaust passage, the $NO_X$ exhausted from the engine when fuel is burned under a lean air-fuel ratio is stored at the $NO_X$ purification catalyst, and when the air-fuel ratio of the exhaust gas should be made rich to release the stored $NO_X$ from the $NO_X$ purification catalyst, the combustion gas of a rich air-fuel ratio is generated in the combustion chamber or a reducing agent is injected from the reducing agent feed valve in accordance with the engine operating state (for example, see PTL 1). In this internal combustion engine, when the air-fuel ratio of the combustion gas in the combustion chamber is switched from lean to rich, when it is made rich, and when it is switched from rich to lean, a large amount of soot is produced and thereby there is a danger that the nozzle holes of the reducing agent feed valve is caused to clog by this large amount of produced soot. Therefore, in this internal combustion engine, in the interval from when the combustion is performed under a rich air-fuel ratio to when next combustion is performed under a rich air-fuel ratio, the reducing agent feed valve is made to inject a small amount of the reducing agent to blow off the soot deposited at the nozzle holes and thereby prevent the nozzle holes of the reducing agent feed valve from clogging.

CITATION LIST

Patent Literature

PTL 1: Japanese Patent Publication No. 2009-270567A

SUMMARY OF INVENTION

Technical Problem

In this regard, up until now, it was thought that if soot were discharged from an engine, the soot would invade the nozzle holes of the reducing agent feed valve and deposit and build up on the inner circumferential surfaces of the nozzle holes and thereby would cause the nozzle holes to clog. Therefore, in the past, as in the above-mentioned internal combustion engine, when a large amount of soot was discharged from an engine, it was judged that there was a danger of the nozzle holes clogging and, therefore, when a large amount of soot was discharged from an engine, a reducing agent for preventing clogging was injected from the reducing agent feed valve to prevent the nozzle holes from clogging. However, the inventors engaged in repeated research on the clogging of nozzle holes and as a result learned that when a reducing agent feed valve is not injecting a reducing agent, even if the engine discharges a large amount of soot, the soot will not invade the nozzle holes and that therefore the discharge of a large amount of soot from an engine is not the cause of clogging of nozzle holes but that clogging is caused by soot being sucked into the nozzle holes at the time of the end of injection of the reducing agent from the reducing agent feed valve.

That is, when stopping the reducing agent feed valve from injecting the reducing agent at the time of the end of injection by making the needle valve close, the reducing agent which is present inside the nozzle holes flows out from the nozzle holes by inertia. As a result, at this time, the nozzle holes temporarily become negative in pressure inside and therefore, at this time, if the exhaust gas around the openings of the nozzle holes which open into the exhaust passage contains soot, the soot is sucked into the nozzle holes and the soot deposits on the inner circumferential surfaces of the nozzle holes. However, even if soot deposits on the inner circumferential surfaces of the nozzle holes in this way, if the reducing agent feed valve performs the next injection within a short time, the soot which is deposited the inner circumferential surfaces of the nozzle holes will be blown off. Therefore, in this case, the nozzle holes will never clog. In this regard, if a long time elapses from when the soot deposits on the inner circumferential surfaces of the nozzle holes, the soot will adhere to the inner circumferential surfaces of the nozzle holes. If the soot adheres to the inner circumferential surfaces of the nozzle holes, even if the reducing agent is injected, the soot will no longer be blown off. As a result, the nozzle holes will clog. Therefore, to prevent the nozzle holes from clogging, it becomes necessary to make the reducing agent feed valve inject the reducing agent by a short period. However, if making the reducing agent feed valve inject the reducing agent by a short period, the amount of consumption of the reducing agent will increase.

Now then, as explained above, if the exhaust gas around the openings of the nozzle holes which open into the exhaust passage contains soot, the soot is sucked into the nozzle holes at the time of end of injection of the reducing agent from the reducing agent feed valve and therefore the soot causes the nozzle holes to clog. As opposed to this, if the exhaust gas around the openings of the nozzle holes which open into the exhaust passage does not contain soot, soot will not be sucked into the nozzle holes if the reducing agent feed valve injects the reducing agent, and soot will no longer deposit on the inner circumferential surfaces of the nozzle holes. Therefore, if the reducing agent feed valve injects the reducing agent when the exhaust gas around the openings of the nozzle holes which open into the exhaust passage does not contain soot, clogging will not occur and therefore it will no longer be necessary to blow off the soot which deposits on the inner circumferential surfaces of the nozzle holes by making the reducing agent feed valve inject the reducing agent by a short period, so it becomes possible to greatly reduce the amount of consumption of the reducing agent. Note that, when the feed of fuel into the combustion chamber is stopped and soot is not produced, the exhaust gas around the openings of the nozzle holes which open into the exhaust passage no longer contain soot. Therefore, if the reducing agent feed valve injects the reducing agent at this time, the amount of consumption of the reducing agent can be greatly reduced.

Solution to Problem

Therefore, in the present invention, there is provided an internal combustion engine comprising a reducing agent feed valve arranged in an engine exhaust passage and a reducing agent injection control device for controlling an action of injection of a reducing agent from the reducing agent feed valve, the reducing agent feed valve being provided with a nozzle hole which opens inside of the engine exhaust passage and being comprised of a type of feed valve which is controlled to open and close at an inside end side of the nozzle hole, and the reducing agent injection control device performing an injection control for exhaust treatment which injects the reducing agent in an amount which is necessary for exhaust treatment and performing an injection control for preventing clogging which injects a smaller amount of reducing agent from the reducing agent feed valve than a reducing agent in an amount which is necessary for exhaust treatment to prevent the nozzle hole of the reducing agent feed valve from clogging, wherein the reducing agent injection control device injects the reducing agent for preventing clogging from the reducing agent feed valve during a period of suspension of the injection control for exhaust treatment when a feed of fuel to a combustion chamber is stopped and stops an injection of the reducing agent for preventing clogging from the reducing agent feed valve after once injecting the reducing agent for preventing clogging from the reducing agent feed valve until the reducing agent injection control for exhaust treatment is resumed.

Advantageous Effects of Invention

When injection control for exhaust treatment is being performed, a reducing agent is periodically injected, so the nozzle holes of the reducing agent feed valve do not become clogged. There is a danger of the nozzle holes clogging only when injection control for exhaust treatment is stopped. Therefore, in the present invention, during the period of suspension of injection control for exhaust treatment when there is a danger of the nozzle holes clogging, a reducing agent for preventing clogging is injected from the reducing agent feed valve when the feed of fuel to the combustion chamber is stopped, that is, when soot is not discharged from the engine. Therefore, when the reducing agent for preventing clogging is injected, the soot will never deposit on the inner circumferential surfaces of the nozzle holes and the nozzle holes will never clog, so injection of reducing agent for preventing clogging from the reducing agent feed valve is stopped until the reducing agent injection control for exhaust treatment is resumed after the reducing agent for preventing clogging is injected. Therefore, it becomes possible to greatly reduce the amount of consumption of the reducing agent.

DESCRIPTION OF EMBODIMENTS

Figure 1:
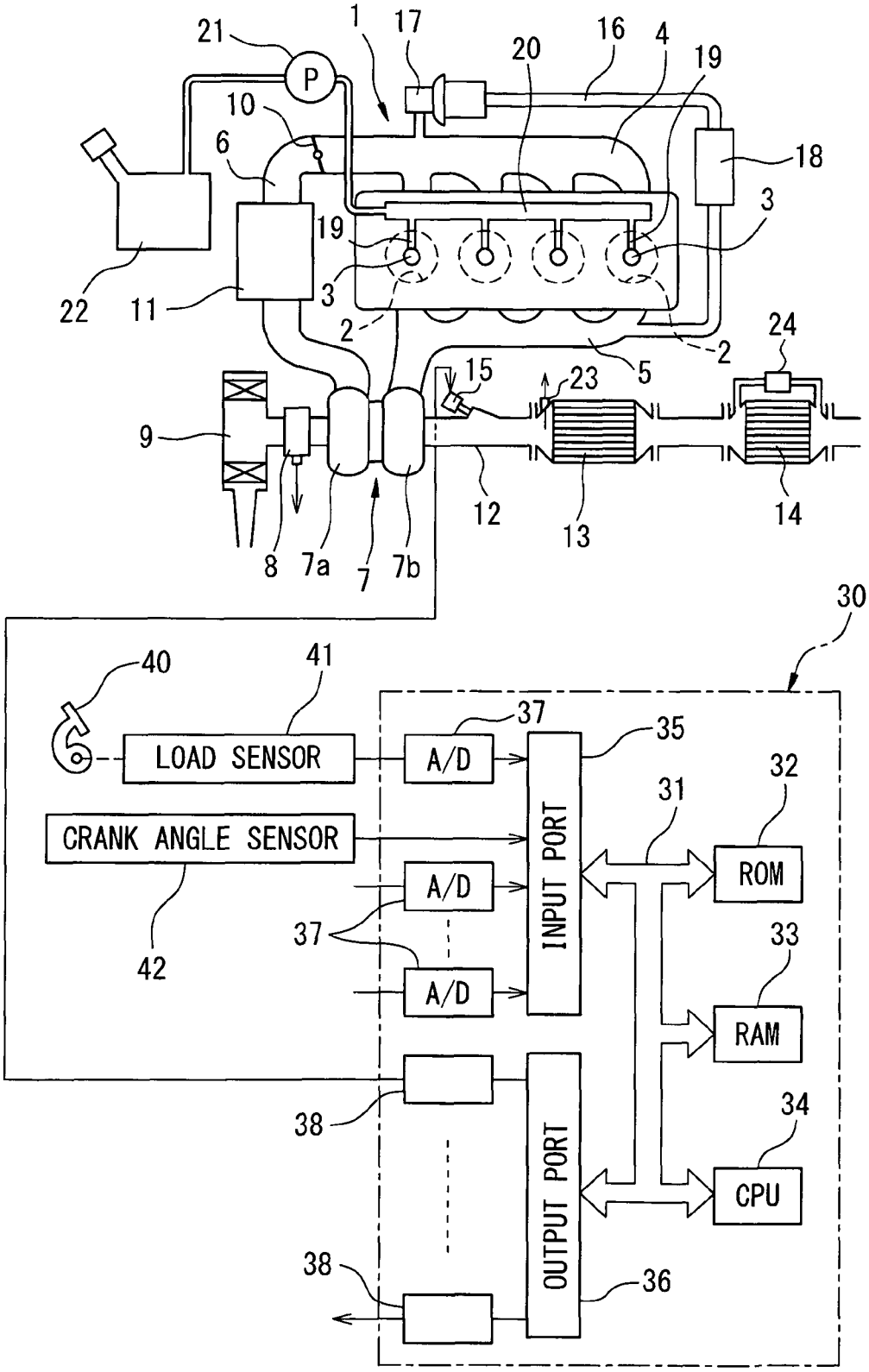
FIG. 1 is an overview of a compression ignition type internal combustion engine.

FIG. 1 is an overall view of a compression ignition type internal combustion engine.

Referring to FIG. 1, 1 indicates an engine body, 2 a combustion chamber of each cylinder, 3 an electronically controlled fuel injector for injecting fuel into each combustion chamber 2, 4 an intake manifold, and 5 an exhaust manifold. The intake manifold 4 is connected through an intake duct 6 to an outlet of a compressor 7*a* of an exhaust turbocharger 7, while an inlet of the compressor 7*a* is connected through an intake air amount detector 8 to an air cleaner 9. Inside the intake duct 6, a throttle valve 10 which is driven by an actuator is arranged. Around the intake duct 6, a cooling device 11 is arranged for cooling the intake air which flows through the inside of the intake duct 6. In the embodiment which is shown in FIG. 1, the engine cooling water is guided to the inside of the cooling device 11 where the engine cooling water is used to cool the intake air.

On the other hand, the exhaust manifold 5 is connected to an inlet of an exhaust turbine 7*b* of the exhaust turbocharger 7, and an outlet of the exhaust turbine 7*b* is connected through an exhaust pipe 12 to an inlet of an exhaust purification catalyst 13. In an embodiment of the present invention, this exhaust purification catalyst 13 is comprised of an $NO_X$ storage catalyst. An outlet of the exhaust purification catalyst 13 is connected to a particulate filter 14 and, upstream of the exhaust purification catalyst 13 inside the exhaust pipe 12, a hydrocarbon feed valve 15 is arranged for feeding hydrocarbons comprised of diesel oil or other fuel used as fuel for a compression ignition type internal combustion engine. In the embodiment shown in FIG. 1, diesel oil is used as the hydrocarbons which are fed from the hydrocarbon feed valve 15. Note that, the present invention can also be applied to a spark ignition type internal combustion engine in which fuel is burned under a lean air-fuel ratio. In this case, from the hydrocarbon feed valve 15, hydrocarbons comprised of gasoline or other fuel used as fuel of a spark ignition type internal combustion engine are fed.

On the other hand, the exhaust manifold 5 and the intake manifold 4 are connected with each other through an exhaust gas recirculation (hereinafter referred to as an "EGR") passage 16. Inside the EGR passage 16, an electronically controlled EGR control valve 17 is arranged. Further, around the EGR passage 16, a cooling device 18 is arranged for cooling the EGR gas which flows through the inside of the EGR passage 16. In the embodiment which is shown in FIG. 1, the engine cooling water is guided to the inside of the cooling device 18 where the engine cooling water is used to cool the EGR gas. On the other hand, each fuel injector 3 is connected through a fuel feed tube 19 to a common rail 20. This common rail 20 is connected through an electronically controlled variable discharge fuel pump 21 to a fuel tank 22. The fuel which is stored inside of the fuel tank 22 is fed by the fuel pump 21 to the inside of the common rail 20. The fuel which is fed to the inside of the common rail 21 is fed through each fuel feed tube 19 to the fuel injector 3.

An electronic control unit 30 is comprised of a digital computer provided with a ROM (read only memory) 32, a RAM (random access memory) 33, a CPU (microprocessor) 34, an input port 35, and an output port 36, which are connected with each other by a bidirectional bus 31. Downstream of the exhaust purification catalyst 13, a temperature sensor 23 is arranged for detecting the temperature of the exhaust gas flowing out from the exhaust purification catalyst 13, and a pressure difference sensor 24 for detecting a pressure difference before and after the particulate filter 14 is attached to the particulate filter 14. The output signals of these temperature sensor 23, pressure difference sensor 24 and intake air amount detector 8 are input through respectively corresponding AD converters 37 to the input port 35. Further, an accelerator pedal 40 has a load sensor 41 connected to it which generates an output voltage proportional to the amount of depression L of the accelerator pedal 40. The output voltage of the load sensor 41 is input through a corresponding AD converter 37 to the input port 35. Furthermore, at the input port 35, a crank angle sensor 42 is connected which generates an output pulse every time a crankshaft rotates by, for example, 15°. On the other hand, the output port 36 is connected through corresponding drive circuits 38 to each fuel injector 3, the actuator for driving the throttle valve 10, hydrocarbon feed valve 15, EGR control valve 17, and fuel pump 21.

Figure 2:
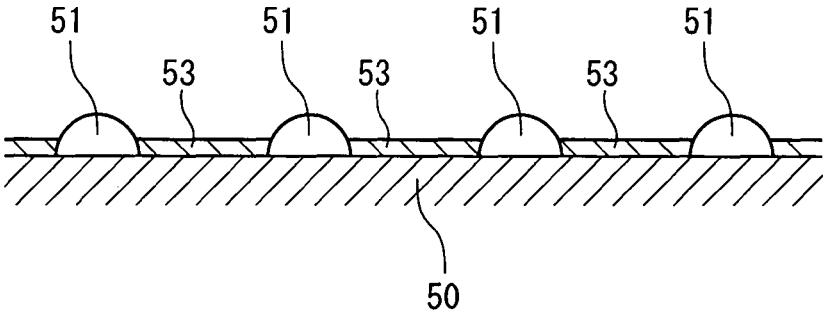
FIG. 2 is a view which schematically shows a surface part of a catalyst carrier.

FIG. 2 schematically shows a surface part of a catalyst carrier which is carried on a substrate of the exhaust purification catalyst 13 shown in FIG. 1. At this exhaust purification catalyst 13, as shown in FIG. 2, for example, there is provided a catalyst carrier 50 made of alumina on which precious metal catalysts 51 comprised of platinum Pt are carried. Furthermore, on this catalyst carrier 50, a basic layer 53 is formed which includes at least one element selected from potassium K, sodium Na, cesium Cs, or another such alkali metal, barium Ba, calcium Ca, or another such alkali earth metal, a lanthanide or another such rare earth and silver Ag, copper Cu, iron Fe, iridium Ir, or another metal able to donate electrons to $NO_X$. In this case, on the catalyst carrier 50 of the exhaust purification catalyst 13, in addition to platinum Pt, rhodium Rh or palladium Pd may be further carried.

As mentioned above, the exhaust purification catalyst 13 is comprised of an $NO_X$ storage catalyst, and if the ratio of the air and fuel (hydrocarbons) which are supplied into the engine intake passage, combustion chambers 2, and upstream of the exhaust purification catalyst 13 in the exhaust passage is referred to as "the air-fuel ratio of the exhaust gas", the exhaust purification catalyst 13 has a function of storing $NO_X$ when the air-fuel ratio of the exhaust gas is lean and releasing the stored $NO_X$ when the air-fuel ratio of the exhaust gas is made rich. Namely, when the air-fuel ratio of the exhaust gas is lean, $NO_X$ contained in the exhaust gas is oxidized on the platinum Pt 51. Then, this NO diffuses in the basic layer 53 in the form of nitrate ions $NO_3^-$ and becomes nitrates. Namely, at this time, $NO_X$ contained in the exhaust gas is absorbed in the form of nitrates inside of the basic layer 53. On the other hand, when the air-fuel ratio of the exhaust gas is made rich, the oxygen concentration in the exhaust gas falls. As a result, the reaction proceeds in the opposite direction ($NO_3^- \rightarrow NO_2$), and consequently the nitrates absorbed in the basic layer 53 successively become nitrate ions $NO_3^-$ and are released from the basic layer 53 in the form of $NO_2$. Next, the released $NO_2$ is reduced by the hydrocarbons HC and CO contained in the exhaust gas.

Figure 3:
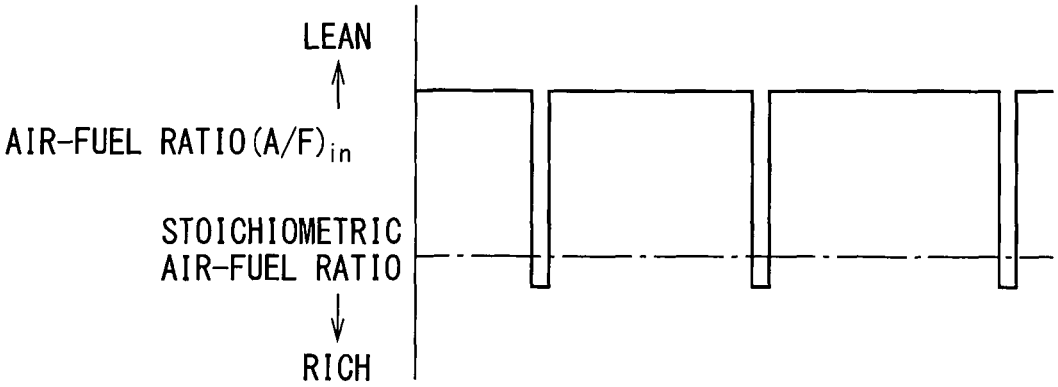
FIG. 3 is a view which shows changes in an air-fuel ratio of exhaust gas which flows into an exhaust purification catalyst.

FIG. 3 shows the case of making the air-fuel ratio (A/F) in of the exhaust gas flowing into the exhaust purification catalyst 13 temporarily rich by making the air-fuel ratio of the combustion gas in the combustion chamber 2 slightly before the $NO_X$ absorption ability of the basic layer 53 becomes saturated. In this case, the air-fuel ratio (A/F) in of the exhaust gas flowing into the exhaust purification catalyst 13 is made temporarily rich by injecting hydrocarbons from the hydrocarbon feed valve 15 only in a particular operating state where the air-fuel ratio of the combustion gas in the combustion chamber 2 cannot be made rich. Note that, in the example shown in FIG. 3, the time interval of this rich control is 1 minute or more. In this case, the $NO_X$ which was absorbed in the basic layer 53 when the air-fuel ratio (A/F) in of the exhaust gas was lean is released all at once from the basic layer 53 and reduced when the air-fuel ratio (A/F) in of the exhaust gas is made temporarily rich. In case where $NO_X$ is removed by using the storage and release action of $NO_X$ in this way, when the catalyst temperature TC is 250° C. to 300° C., an extremely high $NO_X$ purification rate is obtained. However, when the catalyst temperature TC becomes a 350° C. or higher high temperature, the $NO_X$ purification rate falls.

Figure 4A:
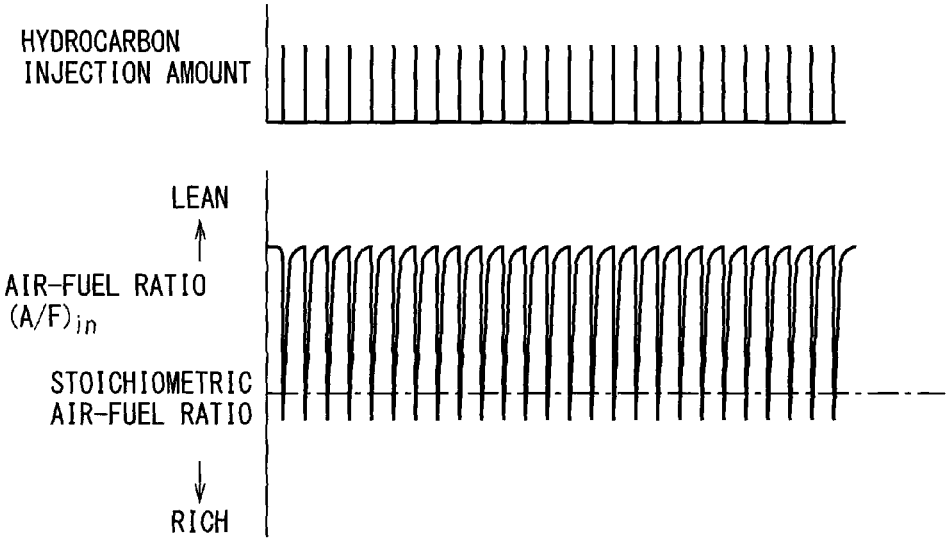
FIGS. 4A and 4B are views which show changes in an amount of injection of hydrocarbon and an air-fuel ratio of exhaust gas which flows into an exhaust purification catalyst.

On the other hand, if injecting hydrocarbons from the hydrocarbon feed valve 15 with a short injection period to make the air-fuel ratio of the exhaust gas rich before $NO_X$ is absorbed in the basic layer 53, reducing intermediates comprised of the isocyanate compound R—NCO and amine compound R—$NH_2$ etc. are produced from hydrocarbons injected from the hydrocarbon feed valve 15 and $NO_X$ contained in the exhaust gas, and these reducing intermediates are held on the basic layer 53 without being absorbed in the basic layer 53. Then, $NO_X$ contained in the exhaust gas is reduced by these reducing intermediates. FIG. 4A shows changes in the amount of hydrocarbons injected from the hydrocarbon feed valve 15 and the air-fuel ratio (A/F) in of the exhaust gas flowing into the exhaust purification catalyst 13 in case where $NO_X$ is removed by producing these reducing intermediates. In this case, a period in which the air-fuel ratio (A/F) in of the exhaust gas flowing into the exhaust purification catalyst 13 is made rich is shorter as compared with the case shown in FIG. 3, and in the example shown in FIG. 4A, the period in which the air-fuel ratio (A/F) in of the exhaust gas flowing into the exhaust purification catalyst 13 is made rich, that is, the injection interval of hydrocarbons from the hydrocarbon feed valve 15 is made 3 seconds.

On the other hand, in case where $NO_X$ is removed by using the storage and release action of $NO_X$, as mentioned above, when the catalyst temperature TC becomes 350° C. or more, the $NO_X$ purification rate falls. This is because if the catalyst temperature TC becomes 350° C. or more, $NO_X$ is less easily stored and the nitrates break down by heat and are released in the form of $NO_2$ from the exhaust purification catalyst 13. That is, so long as storing $NO_X$ in the form of nitrates, when the catalyst temperature TC is high, it is difficult to obtain a high $NO_X$ purification rate. However, in the $NO_X$ purification method shown in FIG. 4A, the amount of $NO_X$ stored in the form of nitrates is small, and consequently, even when the catalyst temperature TC is high of 400° C. or more, a high $NO_X$ purification rate can be obtained. This $NO_X$ purification method shown in FIG. 4A will be referred to below as the "first $NO_X$ purification method", and the $NO_X$ purification method by using the storage and release action of $NO_X$ as shown in FIG. 4A will be referred to below as the "second $NO_X$ purification method"

Note that, as mentioned above, when the catalyst temperature TC is relatively low, the $NO_X$ purification rate by the second $NO_X$ purification method becomes higher, while when the catalyst temperature TC becomes higher, the $NO_X$ purification rate by the first $NO_X$ purification method becomes higher. Accordingly, in the embodiment of the present invention, roughly speaking, when the catalyst temperature TC is low, the second $NO_X$ purification method is used, and when the catalyst temperature TC is high, the first $NO_X$ purification method is used.

Figure 4B:
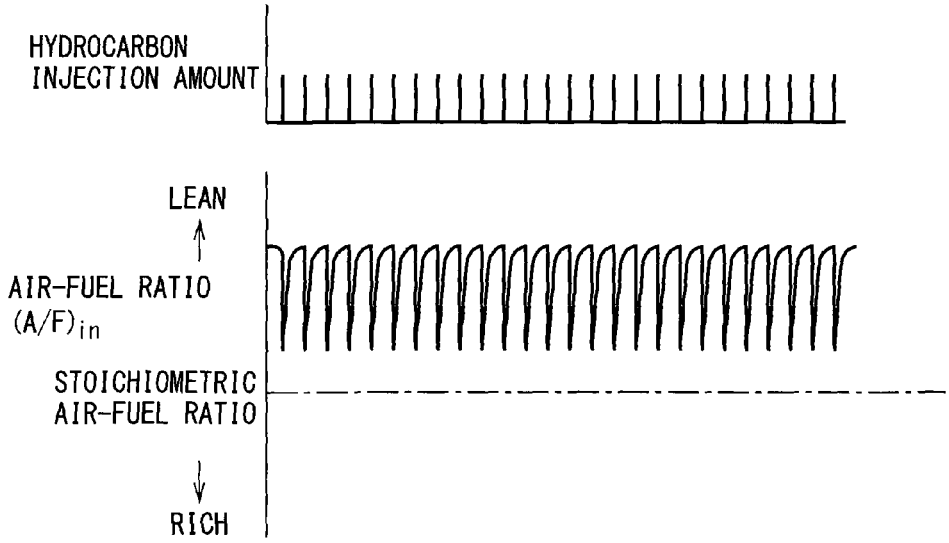

On the other hand, when regenerating the particulate filter 14, hydrocarbons are injected from the hydrocarbon feed valve 15, and the temperature elevation action of the particulate filter 14 is performed due to the heat of oxidation reaction of the injected hydrocarbons. In addition, also when releasing $SO_X$ stored in the exhaust purification catalyst 13 from the exhaust purification catalyst 13, hydrocarbons are injected from the hydrocarbon feed valve 15, and the temperature elevation action of the exhaust purification catalyst 13 is performed due to the heat of oxidation reaction of the injected hydrocarbons. FIG. 4B shows changes in the amount of hydrocarbons injected from the hydrocarbon feed valve 15 and the air-fuel ratio (A/F) in of the exhaust gas flowing into the exhaust purification catalyst 13 in case where hydrocarbons are injected from the hydrocarbon feed valve 15 to raise the temperature of the particulate filter 14 or the exhaust purification catalyst 13 in this way. At this time, as can be seen from FIG. 4B, hydrocarbons are injected from the hydrocarbon feed valve 15 with a short injection period which is similar to that in the case shown in FIG. 4A while maintaining the air-fuel ratio (A/F) in of the exhaust gas flowing into the exhaust purification catalyst 13 lean.

Figure 5A:
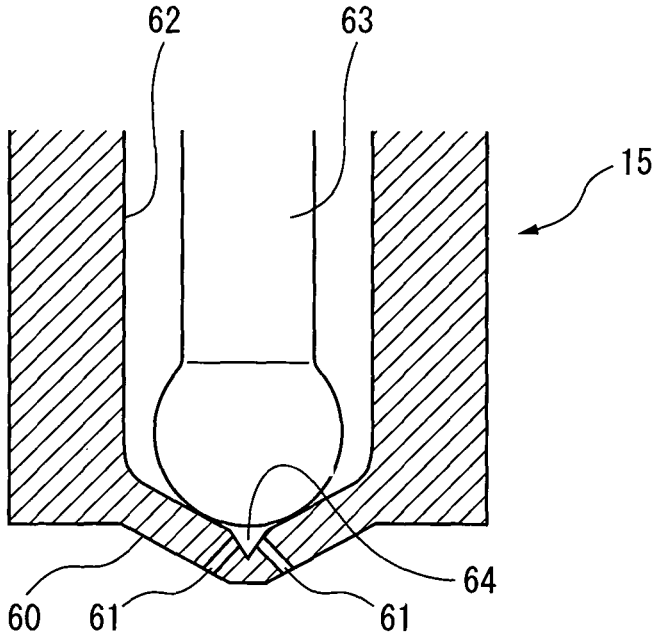
FIGS. 5A and 5B are views for explaining deposition of soot on inner circumferential surfaces of nozzle holes.

Next, referring to FIG. 5A and FIG. 5B, the mechanism of clogging of nozzle holes of the hydrocarbon feed valve 15 which was discovered by the present inventors will be explained. FIG. 5A shows the front end part of the hydrocarbon feed valve 15. The front end face 60 of the front end part of the hydrocarbon feed valve 15 is exposed inside of the exhaust pipe 12. In this front end face 60, a plurality of nozzle holes 61 are formed. At the inside of the front end part of the hydrocarbon feed valve 15, a hydrocarbon chamber 62 which is filled with a liquid hydrocarbon is formed. In this hydrocarbon chamber 62, a needle valve 63 which is driven by a solenoid is arranged. FIG. 5A shows when the needle valve 63 sits on the bottom surface of the hydrocarbon chamber 62. At this time, the injection of hydrocarbons from the nozzle holes 61 is made to stop. Note that, at this time, between the front end face of the needle valve 63 and the bottom surface of the hydrocarbon chamber 62, a suck chamber 64 is formed. The inside end portions of the nozzle holes 61 open to the inside of this suck chamber 64.

If the needle valve 63 is made to rise and separates from the bottom surface of the hydrocarbon chamber 62, the hydrocarbons in the hydrocarbon chamber 62 will be injected through the suck chamber 64 from the nozzle holes 61 into the exhaust pipe 12. Therefore, this hydrocarbon feed valve 15 is comprised of a hydrocarbon feed valve of a type which is provided with nozzle holes 61 which open inside of the engine exhaust passage and is controlled to open and close at the inside end side of the nozzle holes 61. In such a type of hydrocarbon feed valve 15, in the past, it was thought that if the engine discharged soot, the soot would invade the inside of the nozzle holes 61 of the hydrocarbon feed valve 15 and would deposit and build up on the inner circumferential walls of the nozzle holes 61 whereby the nozzle holes 61 would clog. However, the inventors engaged in repeated research on the clogging of nozzle holes 61 and as a result learned that when the hydrocarbon feed valve 15 is not injecting hydrocarbons, even if the engine discharges a large amount of soot, the soot will not invade the nozzle holes 61 and therefore the discharge of a large amount of soot from an engine is not the cause of clogging of nozzle holes 61 but that clogging is caused by soot being sucked into the nozzle holes 61 at the time of end of injection of hydrocarbons from the hydrocarbon feed valve 15.

That is, in a hydrocarbon feed valve 15 of the type such as shown in FIG. 5A, when stopping injection of hydrocarbons from the hydrocarbon feed valve 15 at the time of end of injection by making the needle valve 63 close, the hydrocarbons which are present in the suck chamber 64 and nozzle holes 61 flow out from the nozzle holes 61 by inertia. As a result, at this time, the inside of the suck chamber 64 and the insides of the nozzle holes 61 temporarily become negative pressures. Therefore, at this time, if the exhaust gas around the openings of the nozzle holes 61 which open to the inside of the exhaust passage contains soot, the soot will be sucked into the nozzle holes 61 and suck chamber 64 and the soot will deposit on the inner circumferential surfaces at the insides of the nozzle holes 61 and suck chamber 64. However, even if soot deposits on the inner circumferential surfaces of the nozzle holes 61 and inner circumferential surfaces of the suck chamber 64 in this way, if next injecting fuel from the hydrocarbon feed valve 15 in a short time period, the soot which has deposited on the inner circumferential surfaces of the nozzle holes 61 and inner circumferential surfaces of the suck chamber 64 will be blown off. Therefore, in this case, the nozzle holes 61 will never clog. In this regard, if time elapses from when soot deposited on the inner circumferential surfaces of the nozzle holes 61 and inner circumferential surfaces of the suck chamber 64, the soot will adhere to the inner circumferential surfaces of the nozzle holes 61 and inner circumferential surfaces of the suck chamber 64. If the soot adheres to the inner circumferential surfaces of the nozzle holes 61 and inner circumferential surfaces of the suck chamber 64 in this way, even if hydrocarbons are injected, the soot will no longer be blown off. As a result, the nozzle holes 61 will clog. Next, this action of adherence of the soot will be explained with reference to FIG. 5B.

Figure 5B:
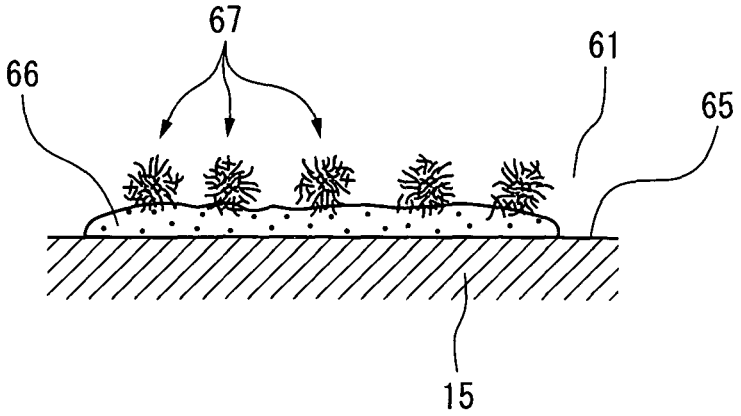

FIG. 5B shows an enlarged cross-sectional view of the inner circumferential surface 65 of the nozzle hole 61. If the hydrocarbon feed valve 15 finishes injecting hydrocarbons, hydrocarbons will usually remain on the inner circumferential surface 65 of the nozzle hole 61 in the form of a liquid. At this time, the remaining liquid hydrocarbons are shown schematically by reference numeral 66 in FIG. 5B. On the other hand, when the hydrocarbon feed valve 15 injects hydrocarbons, if the exhaust gas around the openings of the nozzle holes 61 which open to the inside of the exhaust passage contains soot, at the time when the hydrocarbon feed valve 15 finishes injecting hydrocarbons, the soot will be sucked inside of the nozzle holes 61 and suck chamber 64 and the soot will deposit on the inner circumferential surfaces of the nozzle holes 61 and suck chamber 64. FIG. 5B schematically shows the soot which has deposited on the liquid hydrocarbons 66 on the inner circumferential surfaces 65 of the nozzle holes 61 at this time by the reference numerals 67.

Now then, if the soot 67 which is sucked inside of the nozzle holes 61 and suck chamber 64 contacts the liquid hydrocarbons 66, the pressure at the contact surfaces of the soot 67 and liquid hydrocarbons 66 will become lower than the pressure of the surroundings, so the soot 67 will be pushed toward the liquid hydrocarbons 66 and the soot 67 will be pulled by the interatomic force with the liquid hydrocarbons 66 toward the liquid hydrocarbons 66, so the soot 67 will be held in the state deposited such as shown in FIG. 5B. At this time, the deposition force of the soot 67 to the inner wall surfaces of the nozzle holes 61 and suck chamber 64 is weak. Therefore, if the action of injection of hydrocarbons is performed in such a state, the soot 67 which is deposited on the inner wall surfaces of the nozzle holes 61 and suck chamber 64 will immediately be blown off. Therefore, if the action of injection of hydrocarbons is performed at the time of such a state, the nozzle holes 61 will never clog.

On the other hand, as shown in FIG. 5B, if the state where the soot 67 is deposited on the liquid hydrocarbons 66 continues for a long time, the liquid hydrocarbons and the hydrocarbons in the liquid hydrocarbons which enter into the pores of the soot 67 will polymerize and gradually form polymers and will gradually become stronger in viscosity. If the liquid hydrocarbons 66 become higher in viscosity, the adhering force with respect to the inner wall surfaces of the nozzle holes 61 and suck chamber 64 will become stronger. If the viscosity of the liquid hydrocarbons which have entered the pores of the soot 67 becomes higher, the adhering force with the liquid hydrocarbons 66 will become stronger. That is, if the state of the soot 67 deposited on the liquid hydrocarbons 66 continues for a long time, the adhering force of the soot 67 with the inner wall surfaces of the nozzle holes 61 and suck chamber 64 will become stronger. If in this way the adhering force of the soot 67 with respect to the inner wall surfaces of the nozzle holes 61 and suck chamber 64 becomes stronger, even if the action of injecting hydrocarbons is performed, the soot 67 which deposits on the inner wall surfaces of the nozzle holes 61 and suck chamber 64 will remain adhered without being blown off. Therefore, in this case, the soot 67 will cause the nozzle holes 61 to clog.

In this case, to prevent the soot 67 from causing the nozzle holes 61 to clog, it is sufficient to inject hydrocarbons when the adhering force of the soot 67 to the inner wall surfaces of the nozzle holes 61 and suck chamber 64 is not that strong, that is, at the time of an adhering force of an extent where if injecting hydrocarbons, the soot 67 which is deposited on the inner wall surfaces of the nozzle holes 61 and suck chamber 64 will end up being blown off. If referring to the highest adhering force in the adhering force, under which the soot 67 deposited on the inner wall surfaces of the nozzle holes 61 and suck chamber 64 will be blown off in this way if hydrocarbons are injected, as the "limit adhering force", when the adhering force of the soot 67 is weaker than this limit adhering force, if the action of injecting hydrocarbons is performed, the soot 67 which is deposited on the inner wall surfaces of the nozzle holes 61 and suck chamber 64 will be blown off, while when the adhering force of the soot 67 becomes stronger than this limit adhering force, if the action of injecting hydrocarbons is performed, the soot 67 which is deposited on the inner wall surfaces of the nozzle holes 61 and suck chamber 64 will remain adhered without being blown off. Next, this limit adhering force will be explained while referring to FIG. 6A taking as an example the case where a certain fixed amount of soot 67 has deposited on the inner wall surfaces of the nozzle holes 61 and suck chamber 64.

Figure 6A:
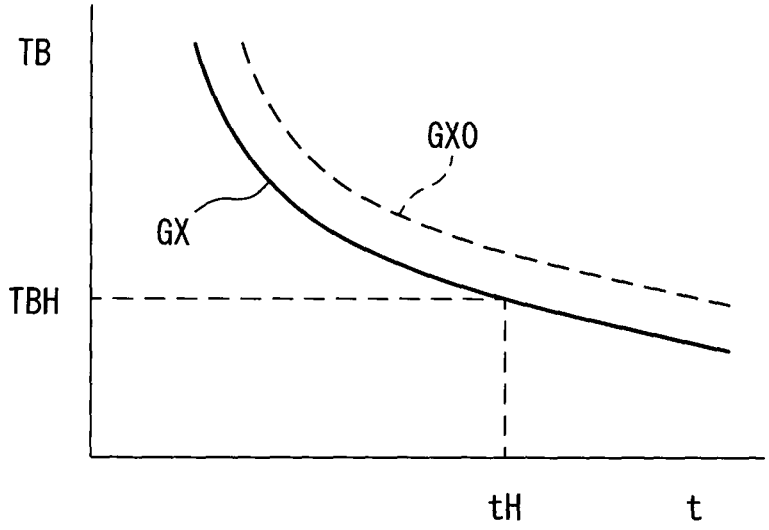
FIGS. 6A and 6B are views for explaining a relationship between a temperature and a time etc, until soot adheres.

This limit adhering force is shown in FIG. 6A by the broken line GXO. Note that, in FIG. 6A, the ordinate TB shows the temperature of the front end face 60 of the hydrocarbon feed valve 15, while "t" shows the elapsed time from when the action of the hydrocarbon feed valve 15 injecting hydrocarbons is ended. The higher the temperature TB of the front end face 60 of the hydrocarbon feed valve 15, that is, the higher the temperatures of the inner wall surfaces of the nozzle holes 61 and suck chamber 64, the more the action of polymerization of the liquid hydrocarbons 66 and the action of polymerization of the hydrocarbons in the liquid hydrocarbons which enter the pores of the soot 67 progress and the more rapidly the viscosity becomes stronger. Therefore, the higher the temperature TB of the front end face 60 of the hydrocarbon feed valve 15, the faster the degree of adherence to the inner wall surfaces of the nozzle holes 61 and suck chamber 64 rises and the shorter the elapsed time "t" from when the action of the hydrocarbon feed valve 15 injecting hydrocarbons is ended until when the adhering force becomes the limit adhering force GXO. Therefore, as shown in FIG. 6A, the higher the temperature TB of the front end face 60 of the hydrocarbon feed valve 15, the shorter the elapsed time "t" by which the adhering force reaches the limit adhering force GXO.

In this embodiment according to the present invention, an allowable adherence degree GX with a degree of adherence which is somewhat weaker than the limit adhering force GXO is set in advance. When the degree of adherence reaches the limit of this allowable adherence degree GX, the hydrocarbon feed valve 15 injects hydrocarbons to blow off the soot 67 which has deposited on the inner wall surfaces of the nozzle holes 61 and suck chamber 64. Next, one example of the method of calculation of this degree of adherence will be explained. Now then, in FIG. 6A, in case where the temperature TB of the front end face 60 of the hydrocarbon feed valve 15 is TBH, if the time tH has elapsed after the injection of hydrocarbons from the hydrocarbon feed valve 15 is performed, the degree of adherence reaches the limit of the allowable adherence degree GX. Therefore, if assuming that the temperature TB of the front end face 60 of the hydrocarbon feed valve 15 was TBH over the $\Delta T$ time period, it can be considered at this time that the degree of adherence advanced toward the limit of the allowable adherence degree GX by exactly $\Delta T/tH$ percent. Therefore, when calculating the value of $\Delta T/tH$ for the successively changing temperatures TB of the front end face 60 of the hydrocarbon feed valve 15 and cumulatively adding the calculated values of $\Delta T/tH$, it is possible to judge that the degree of adherence has reached the limit of the allowable adherence degree GX when the cumulative value becomes 100%.

Figure 6B:
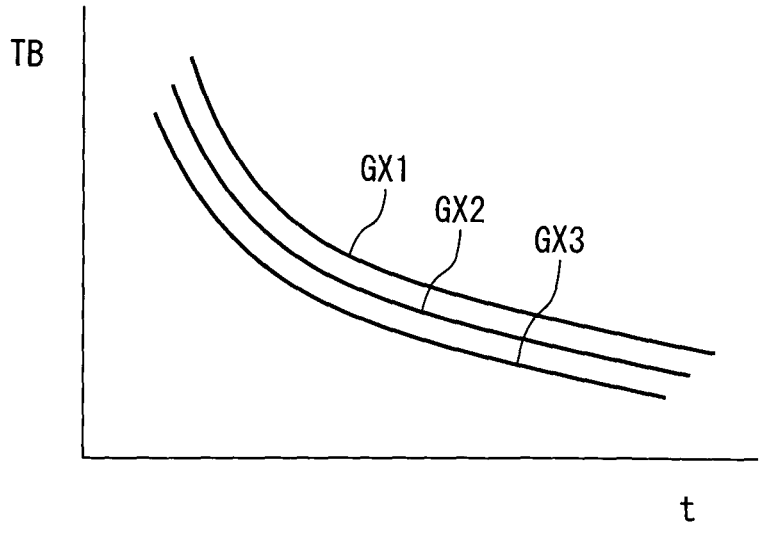

Note that, in this case, the allowable adherence degree GX changes in accordance with the amount of soot 67 which deposits on the inner wall surfaces of the nozzle holes 61 and suck chamber 64 when the hydrocarbon feed valve 15 last injected hydrocarbons. That is, the greater the amount of soot 67 which deposits on the inner wall surfaces of the nozzle holes 61 and suck chamber 64 when the hydrocarbon feed valve 15 last injected fuel, the more the amount of soot 67 which is polymerized increases, so the degree of adherence reaches the limit of the allowable adherence degree GX at an early timing. Therefore, the greater the amount of soot 67 which deposits on the inner wall surfaces of the nozzle holes 61 and suck chamber 64 at the time of the last injection from the hydrocarbon feed valve 15, the lower the curve which shows the limit of the allowable adherence degree becomes positioned as shown in FIG. 6B by GX1, GX2, and GX3. In this embodiment according to the present invention, the allowable adherence degrees GX1, GX2, GX3, . . . corresponding to the amount of soot 67 which is deposited at the inner wall surfaces of the nozzle holes 61 and suck chamber 64 when hydrocarbons were last injected from the hydrocarbon feed valve 15 are stored in advance as functions of the temperature TB of the front end face 60 of the hydrocarbon feed valve 15 and the elapsed time "t" from when the hydrocarbons were injected from the hydrocarbon feed valve 15.

Figure 7:
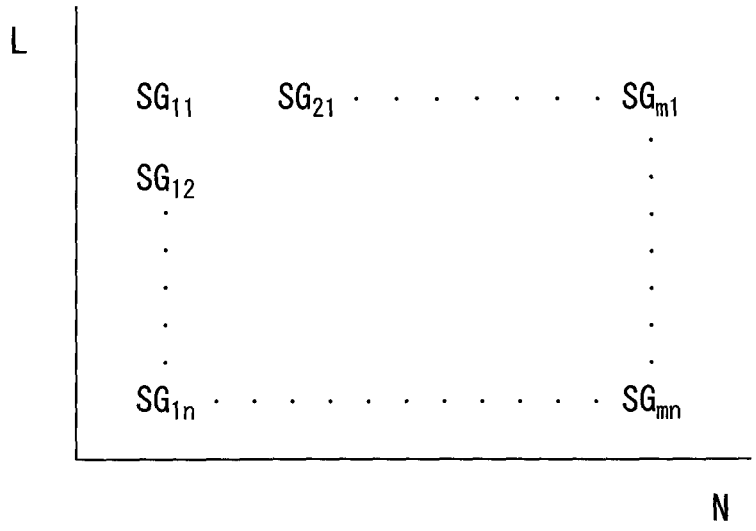
FIG. 7 is a view which shows a map of an amount of discharge of soot.

On the other hand, the amount SG of soot 67 which is deposited on the inner wall surfaces of the nozzle holes 61 and suck chamber 64 when the hydrocarbons were last injected from the hydrocarbon feed valve 15 is believed to be proportional to the amount of soot which is discharged from the engine when the hydrocarbons were last injected from the hydrocarbon feed valve 15. The amount of soot which is discharged from the engine is determined from the engine operating state. Therefore, in this embodiment according to the present invention, the amount SC of soot 67 which is deposited on the inner wall surfaces of the nozzle holes 61 and suck chamber 64 when hydrocarbons were injected from the hydrocarbon feed valve 15 is stored in advance as a function of the amount of depression L of the accelerator pedal 40 and the engine speed N in the form of a map such as shown in FIG. 7.

Now then, as explained above, soot 67 deposits on the inner wall surfaces of the nozzle holes 61 and suck chamber 64 because soot is sucked into the nozzle holes 61 and suck chamber 64 when the hydrocarbon feed valve 15 finishes injecting hydrocarbons. If, at the time of end of injection of hydrocarbons from the hydrocarbon feed valve 15, the exhaust gas around the openings of the nozzle holes 61 which open to the exhaust passage does not contain soot, that is, if making the hydrocarbon feed valve 15 inject hydrocarbons when the exhaust gas around the openings of the nozzle holes 61 which open to the exhaust passage does not contain soot, soot will not be sucked inside of the nozzle holes 61 and soot will no longer deposit on the inner wall surfaces of the nozzle holes 61 and suck chamber 64. If soot does not deposit on the inner wall surfaces of the nozzle holes 61 and suck chamber 64, clogging will not occur and there is no longer a need to blow off soot which deposits on the inner wall surfaces of the nozzle holes 61 and suck chamber 64 by injecting hydrocarbons from the hydrocarbon feed valve 15. As a result, it becomes possible to reduce the amount of consumption of hydrocarbons.

In this regard, in this embodiment according to the present invention, as shown in FIG. 3, when $NO_x$ should be released from the exhaust purification catalyst 13, the air-fuel ratio (A/F) in of the exhaust gas which flows into the exhaust purification catalyst 13 is made temporarily rich. In this case, as explained above, only at the time of specific operating conditions where the air-fuel ratio of the combustion gas in the combustion chamber 2 cannot be made rich, the air-fuel ratio (A/F) in of the exhaust gas which flows into the exhaust purification catalyst 13 is made temporarily rich by injecting hydrocarbons from the hydrocarbon feed valve 15. Further, when using the first NOx removal method to remove $NO_x$, as shown in FIG. 4A, hydrocarbons are injected from the hydrocarbon feed valve 15 by a short period. On the other hand, when performing the action of raising the temperature of the particulate filter 14 to regenerate the particulate filter 14, as shown in FIG. 4B, hydrocarbons are injected from the hydrocarbon feed valve 15 by a short period while maintaining the air-fuel ratio (A/F) in of the exhaust gas which flows into the exhaust purification catalyst 13 lean. Further, as explained above, when performing the action of raising the temperature of the exhaust purification catalyst 13 in case where the $SO_x$ stored in the exhaust purification catalyst 13 is made to be released from the exhaust purification catalyst 13, as shown in FIG. 4B, hydrocarbons are injected from the hydrocarbon feed valve 15 by a short period while maintaining the air-fuel ratio (A/F) in of the exhaust gas which flows into the exhaust purification catalyst 13 lean.

In this way, in an exhaust treatment device such as an exhaust purification catalyst 13 or particulate filter 14, if calling the control for injecting the hydrocarbons required for exhaust purification treatment from the hydrocarbon feed valve 15 or the control for injecting the hydrocarbons required for the action of raising the temperature of the exhaust purification catalyst 13 or particulate filter 14 from the hydrocarbon feed valve 15 the "injection control for exhaust treatment", while this injection control is being continuously performed, even if soot deposits on the inner wall surfaces of the nozzle holes 61 and suck chamber 64 when hydrocarbons are injected from the hydrocarbon feed valve 15, this soot will be blown off when hydrocarbons are next injected from the hydrocarbon feed valve 15 and therefore during this time the nozzle holes 61 will never clog.

As opposed to this, when the second NOx removal method is used to perform the action of removal of $NO_x$ and if the air-fuel ratio (A/F) in of the exhaust gas which flows into the exhaust purification catalyst 13 is made temporarily rich by making the air-fuel ratio of the combustion gas in the combustion chamber 2 rich when $NO_x$ should be released from the exhaust purification catalyst 13, the action of the hydrocarbon feed valve 15 injecting hydrocarbons is not performed. Therefore, in this case, that is, when the above-mentioned injection control for exhaust treatment is stopped, there is the danger of the nozzle holes 61 clogging. Therefore, at this time, to prevent the nozzle holes 61 from clogging, it is necessary to inject hydrocarbons from the hydrocarbon feed valve 15. In this case, when the exhaust gas around the openings of the nozzle holes 61 which open to the exhaust passage does not contain soot, if hydrocarbons are injected from the hydrocarbon feed valve 15, the soot which deposits on the inner wall surfaces of the nozzle holes 61 and suck chamber 64 will be blown off at the time of start of injection, but soot will not be sucked into the nozzle holes 61 at the time of end of injection and soot will no longer deposit on the inner wall surfaces of the nozzle holes 61 and suck chamber 64. Therefore, the nozzle holes 61 will no longer clog. That is, if making the hydrocarbon feed valve 15 inject hydrocarbons once, after that, there is no longer a need to blow off soot which deposits on the inner wall surfaces of the nozzle holes 61 and suck chamber 64 by injecting hydrocarbons from the hydrocarbon feed valve 15. Therefore, it becomes possible to reduce the amount of consumption of hydrocarbons.

Therefore, in the present invention, when the feed of fuel into the combustion chamber 2 is stopped, the hydrocarbons for preventing clogging are made to be injected from the hydrocarbon feed valve 15. When the feed of fuel into the combustion chamber 2 is stopped, no soot is discharged from the engine. Therefore, at this time, the exhaust gas around the openings of the nozzle holes 61 which open to the exhaust passage does not contain any soot at all. Therefore, at this time, if injecting the hydrocarbons for preventing clogging from the hydrocarbon feed valve 15, the soot which deposits on the inner wall surfaces of the nozzle holes 61 and suck chamber 64 at the time of start of injection will be blown off, but soot will not be sucked into the nozzle holes at the time of end of injection and soot will not deposit on the inner wall surfaces of the nozzle holes 61 and suck chamber 64. Note that, the amount of injection of the hydrocarbons for preventing clogging at this time need only be an amount of hydrocarbons of an extent which fills the entire volume of the nozzle holes 61 and suck chamber 64 at the time of start of injection. Therefore, in this embodiment according to the present invention, the amount of injection of the hydrocarbons for preventing clogging is made an amount which fills the entire volume of the nozzle holes 61 and suck chamber 64. If calling this injection control of the hydrocarbons for preventing clogging the "injection control for preventing clogging", in the present invention, to prevent the nozzle holes 61 of the hydrocarbon feed valve 15 from clogging, the injection control for preventing clogging which injects a smaller amount of hydrocarbons from the hydrocarbon feed valve 15 compared with the amount of hydrocarbons which is required for exhaust treatment is performed.

Note that, "when the feed of fuel to the combustion chamber 2 is stopped" is when the feed of fuel to the combustion chamber 2 is stopped at the time of decelerating operation of the vehicle or when the engine is stopped. "When the engine is stopped" is when the driver performs an operation to stop the engine, for example, when the driver turns the ignition switch off or when, for example, the internal combustion engine is automatically stopped in a hybrid engine which uses an internal combustion engine and electric motor as drive sources. At this time, the hydrocarbons for preventing clogging are injected from the hydrocarbon feed valve 15 when the revolution of the engine stops.

In this regard, even if using a reducing agent constituted by a urea aqueous solution for reducing $NO_x$ and arranging a urea aqueous solution feed valve for injecting the urea aqueous solution into the exhaust passage at the inside of the engine exhaust passage, a similar problem arises. That is, when the exhaust gas around the openings of the nozzle holes of the urea aqueous solution feed valve which open to the inside of the exhaust passage contains soot, if injecting the urea aqueous solution from the urea aqueous solution feed valve, the soot is sucked into the nozzle holes and the soot deposits on the inside wall surfaces of the nozzle holes to cause clogging. In this case as well, when the exhaust gas around the openings of the nozzle holes which open to the inside of the exhaust passage does not contain soot, if making the urea aqueous solution feed valve inject the urea aqueous solution, soot will not be sucked into the nozzle holes and soot will no longer deposit on the inner wall surfaces of the nozzle holes. Therefore, clogging is no longer caused.

In this way, the present invention can be applied in a case where a reducing agent constituted by hydrocarbons is used or a case where a reducing agent constituted by a urea aqueous solution is used. Therefore, if referring to the feed valve for feed of hydrocarbons or urea aqueous solution as the "reducing agent feed valve 15", in the present invention, in an internal combustion engine comprising a reducing agent feed valve 15 arranged in an engine exhaust passage and a reducing agent injection control device for controlling an action of injection of a reducing agent from the reducing agent feed valve 15, the reducing agent feed valve 15 being provided with a nozzle hole 61 which opens inside of the engine exhaust passage and being comprised of a type of feed valve which is controlled to open and close at an inside end side of the nozzle hole 61, and the reducing agent injection control device performing an injection control for exhaust treatment which injects the reducing agent in an amount which is necessary for exhaust treatment and performing an injection control for preventing clogging which injects a smaller amount of reducing agent from the reducing agent feed valve 15 than a reducing agent in an amount which is necessary for exhaust treatment to prevent the nozzle hole 61 of the reducing agent feed valve from clogging, the reducing agent injection control device injects the reducing agent for preventing clogging from the reducing agent feed valve 15 during a period of suspension of the injection control for exhaust treatment when a feed of fuel to a combustion chamber 2 is stopped and stops an injection of the reducing agent for preventing clogging from the reducing agent feed valve 15 after once injecting the reducing agent for preventing clogging from the reducing agent feed valve 15 until the reducing agent injection control for exhaust treatment is resumed.

In this case, in the first embodiment, the reducing agent injection control device injects the reducing agent for preventing clogging from reducing agent feed valve 15 only during the period of suspension of injection control for exhaust treatment when the feed of fuel to the combustion chamber 2 is stopped and stops the injection of the reducing agent for preventing clogging from the reducing agent feed valve 15 after once injecting the reducing agent for preventing clogging from the reducing agent feed valve 15 until the reducing agent injection control for exhaust treatment is resumed. In this first embodiment, only when there is no danger of soot being sucked into the nozzle holes 61, the reducing agent for preventing clogging is injected from the reducing agent feed valve 15. Note that, in this embodiment according to the present invention, the electronic control unit 30 which is shown in FIG. 1 forms the reducing agent injection control device.

On the other hand, in the second embodiment, the reducing agent injection control device allows injection of the reducing agent for preventing clogging from the reducing agent feed valve 15 even during the same period of suspension of the reducing agent injection control for exhaust treatment in case where the reducing agent for preventing clogging is injected from the reducing agent feed valve 15 during the period of suspension of the injection control for exhaust treatment when the feed of fuel to the combustion chamber 2 is not stopped. That is, during the period of suspension of the injection control for exhaust treatment, usually a deceleration operation is performed once, therefore the feed of fuel to the combustion chamber 2 is stopped once. However, during the period of suspension of the injection control for exhaust treatment, when the feed of fuel to the combustion chamber 2 is not stopped, even if the exhaust gas contains soot, that is, even if there is the danger of clogging, the reducing agent for preventing clogging is injected from the reducing agent feed valve 15. In this case, if the danger of clogging again arises, the reducing agent for preventing clogging is again injected from the reducing agent feed valve 15. That is, in the second embodiment, during the same period of suspension of the reducing agent injection control for exhaust treatment, after the reducing agent for preventing clogging is injected from the reducing agent feed valve 15, it is allowed to again have the reducing agent for preventing clogging injected from the reducing agent feed valve 15.

In this case, in this second embodiment, the reducing agent injection control device calculates the degree of adherence of soot in the nozzle holes 61, and the reducing agent injection control device injects the reducing agent for preventing clogging from the reducing agent feed valve 15 when the calculated degree of adherence of the soot reaches the limits of the allowable adherence degrees GX1, GX2, and GX3 during the period of suspension of the injection control for exhaust treatment before the feed of fuel to the combustion chamber 2 is stopped. This degree of adherence is calculated based on the amount SG of soot deposited when the reducing agent is injected from the reducing agent feed valve 15, the temperature TB representing the temperature of the inner wall surfaces of the nozzle holes 61 of the reducing agent feed valve 15, and the elapsed time period "t" after injection of the reducing agent feed valve 15 is stopped.

Figure 8:
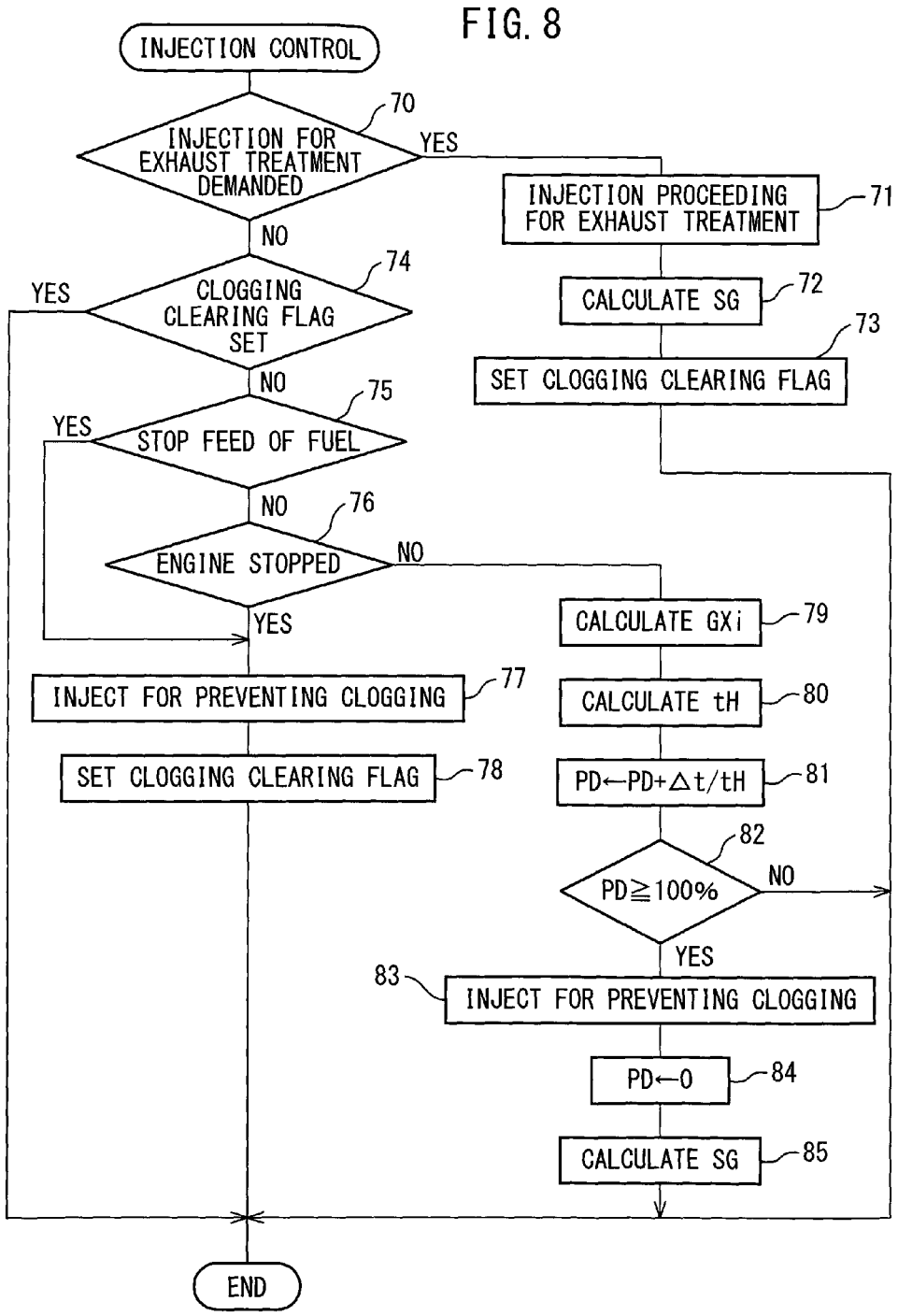
FIG. 8 is a flow chart for injection control.

FIG. 8 shows an injection control routine in the case of using a reducing agent constituted by hydrocarbons in the second embodiment. This routine is executed by interruption every predetermined time interval. Referring to FIG. 8, first, at step 70, it is judged if the injection control for exhaust treatment which makes the hydrocarbon feed valve 15 inject the amount of hydrocarbons which is required for exhaust treatment is being demanded. When the injection control for exhaust treatment is being demanded, the routine proceeds to step 71 where injection treatment for exhaust treatment is performed in accordance with the demand. That is, hydrocarbons are injected from the hydrocarbon feed valve 15 to make the air-fuel ratio (A/F) in of the exhaust gas which flows into the exhaust purification catalyst 13 temporarily rich and release $NO_x$ from the exhaust purification catalyst 13, hydrocarbons are injected from the hydrocarbon feed valve 15 by a short period to use the first NO purification method to remove $NO_x$, hydrocarbons are injected by a short period from the hydrocarbon feed valve 15 while maintaining the air-fuel ratio (A/F) in of the exhaust gas which flows into the exhaust purification catalyst 13 lean to perform the action of raising the temperature of the particulate filter 14, or hydrocarbons are injected by a short period from the hydrocarbon feed valve 15 while maintaining the air-fuel ratio (A/F) in of the exhaust gas which flows into the exhaust purification catalyst 13 lean to perform the action of raising the temperature of the exhaust purification catalyst 13 so as to make the $SO_x$ stored at the exhaust purification catalyst 13 be released from the exhaust purification catalyst 13.

Next, at step 72, each time the action of injecting hydrocarbons from the hydrocarbon feed valve 15 is performed, the amount SG of soot 67 which deposits on the inner wall surfaces of the nozzle holes 61 and suck chamber 64 is calculated from the map which is shown in FIG. 7. This amount SG of soot 67 shows the amount of soot 67 which deposits on the inner wall surfaces of the nozzle holes 61 and suck chamber 64 when hydrocarbons are last injected from the hydrocarbon feed valve 15. Next, a clogging clearing flag which shows that the clogging of the nozzle holes 61 of the hydrocarbon feed valve 15 has been completely cleared is reset. On the other hand, when it is judged at step 70 that injection control for exhaust treatment is not demanded, that is, when an action of removal of $NO_x$ by the second $NO_x$ purification method is being performed and the air-fuel ratio (A/F) in of the exhaust gas which flows into the exhaust purification catalyst 13 is made temporarily rich by making the air-fuel ratio of the combustion gas in the combustion chamber 2 temporarily rich to release $NO_x$ from the exhaust purification catalyst 13, that is, when the action of injection of hydrocarbons from the hydrocarbon feed valve 15 is stopped, the routine proceeds to step 74 where it is judged if the clogging clearing flag is set. When the clogging clearing flag is not set, the routine proceeds to step 75 where it is judged if the operating state is one where no soot at all is discharged from the combustion chamber 2.

That is, at step 75, it is judged if the feed of fuel from the fuel injector 3 is stopped at the time of deceleration of the vehicle. When it is judged at step 75 that the feed of fuel from the fuel injector 3 is not stopped at the time of deceleration of the vehicle, the routine proceeds to step 76 where it is judged if the engine is stopped. When it is judged at step 75 that the feed of fuel from the fuel injector 3 is stopped at the time of deceleration of the vehicle or when it is judged at step 76 that the engine is stopped, the routine proceeds to step 77 where a small amount of the hydrocarbons for preventing clogging is injected from the hydrocarbon feed valve 15. Next, the routine proceeds to step 78 where the clogging clearing flag is set. If the clogging clearing flag is once set, next the routine proceeds through step 74 and the processing cycle is ended. Therefore, so long as it is judged at step 70 that the injection control for exhaust treatment is not being demanded, that is, during the period where the injection control for exhaust treatment is stopped, injection from the hydrocarbon feed valve 15 for preventing clogging is stopped.

On the other hand, when the action of stopping the feed of fuel from the fuel injector 3 at the time of deceleration of the vehicle is not performed and the engine is not stopped, the routine proceeds to step 79 where the allowable adherence degrees GX1, GX2, and GX3 which are shown in FIG. 6B are found based on the amount SG of soot 67 which deposits on the inner wall surfaces of the nozzle holes 61 and suck chamber 64 when hydrocarbons were last injected from the hydrocarbon feed valve 15. Next, at the step 80, the elapsed time tH until the degree of adherence of soot at the temperature TB of the front end face 60 of the hydrocarbon feed valve 15 reaches the limit of the allowable adherence degree GXi is found from the found allowable adherence degree GXi. Note that, in this case, the temperature TB of the front end face 60 of the hydrocarbon feed valve 15 is estimated from the detection signal of the temperature sensor 23. Next, at step 81, the value of the ratio ΔT/tH of the routine interrupt time ΔT to the elapsed time tH is added to the PD to thereby calculate the cumulative value PD of the value of ΔT/tH.

Next, at step 82, it is judged if the cumulative value PD of the value of ΔT/tH reaches 100%. When the cumulative value PD of the value of ΔT/tH reaches 100%, the routine proceeds to step 83 where a small amount of hydrocarbons for preventing clogging is injected from the hydrocarbon feed valve 15. Next, at step 84, the cumulative value PD of the value of ΔT/tH is cleared. Next, at step 85, the amount SG of soot 67 which deposits on the inner circumferential walls of the nozzle holes 61 and suck chamber 64 when the injection for preventing clogging from the hydrocarbon feed valve 15 is performed is calculated.

Note that, in the injection control routine which is shown in FIG. 8, if deleting step 72 and steps 79 to 85, the result becomes the routine for working the first embodiment.

REFERENCE SIGNS LIST

4 intake manifold
5 exhaust manifold
7 exhaust turbocharger
12 exhaust pipe
13 exhaust purification catalyst
14 particulate filter
15 hydrocarbon feed valve

The invention claimed is:

1. An internal combustion engine, comprising:

a reducing agent feed valve arranged in an engine exhaust passage; and a reducing agent injection control device for controlling an action of injection of a reducing agent from the reducing agent feed valve, the reducing agent injection control device including an electronic control unit comprising a processor, wherein the reducing agent feed valve is provided with a nozzle hole which opens inside of the engine exhaust passage and is comprised of a type of feed valve which is controlled to open and close at an inside end side of the nozzle hole, wherein the reducing agent injection control device is configured to perform an injection control for exhaust treatment, such that the reducing agent is injected in an amount, which is necessary for exhaust treatment, wherein the reducing agent injection control device is configured to perform an injection control for preventing clogging, such that the reducing agent is injected from the reducing agent feed valve in a smaller amount than the amount, which is necessary for exhaust treatment, to prevent the nozzle hole of the reducing agent feed valve from clogging, wherein the reducing agent injection control device is configured such that the reducing agent for preventing clogging from the reducing agent feed valve is injected during a period of suspension of the injection control for exhaust treatment, when a feed of fuel to a combustion chamber is stopped and soot is not discharged from the engine, wherein the reducing agent injection control device is configured such that an injection of the reducing agent for preventing clogging from the reducing agent feed valve is stopped after once injecting the reducing agent for preventing clogging from the reducing agent feed valve until the reducing agent injection control for exhaust treatment is resumed, wherein the reducing agent injection control device is configured to allow injection of the reducing agent for preventing clogging from the reducing agent feed valve even during the same period of suspension of the reducing agent injection control for exhaust treatment, in a case where the reducing agent for preventing clogging is injected from the reducing agent feed valve during the period of suspension of the injection control for exhaust treatment, when the feed of fuel to the combustion chamber is not stopped, wherein the reducing agent injection control device is configured to calculate a degree of adherence of soot in the nozzle hole, and wherein the reducing agent injection control device is configured, such that the reducing agent for preventing clogging from the reducing agent feed valve is injected, when a calculated degree of adherence of soot reaches a limit of an allowable adherence degree during the period of suspension of the injection control for exhaust treatment, before the feed of fuel to the combustion chamber is stopped.

2. An internal combustion engine, comprising:

a reducing agent feed valve arranged in an engine exhaust passage; and a reducing agent injection control device for controlling an action of injection of a reducing agent from the reducing agent feed valve, the reducing agent injection control device including an electronic control unit comprising a processor, wherein the reducing agent feed valve is provided with a nozzle hole which opens inside of the engine exhaust passage and is comprised of a type of feed valve which is controlled to open and close at an inside end side of the nozzle hole, wherein the reducing agent injection control device is configured to perform an injection control for exhaust treatment, such that the reducing agent is injected in an amount, which is necessary for exhaust treatment, wherein the reducing agent injection control device is configured to perform an injection control for preventing clogging, such that the reducing agent is injected from the reducing agent feed valve in a smaller amount than the amount, which is necessary for exhaust treatment, to prevent the nozzle hole of the reducing agent feed valve from clogging, wherein the reducing agent injection control device is configured such that the reducing agent for preventing clogging from the reducing agent feed valve is injected during a period of suspension of the injection control for exhaust treatment, when a feed of fuel to a combustion chamber is stopped and soot is not discharged from the engine, wherein the reducing agent injection control device is configured such that an injection of the reducing agent for preventing clogging from the reducing agent feed valve is stopped after once injecting the reducing agent for preventing clogging from the reducing agent feed valve until the reducing agent injection control for exhaust treatment is resumed, wherein the reducing agent injection control device is configured to allow injection of the reducing agent for preventing clogging from the reducing agent feed valve even during the same period of suspension of the reducing agent injection control for exhaust treatment, in a case where the reducing agent for preventing clogging is injected from the reducing agent feed valve during the period of suspension of the injection control for exhaust treatment, when the feed of fuel to the combustion chamber is not stopped, wherein the reducing agent injection control device is configured to calculate a degree of adherence of soot in the nozzle hole, wherein the reducing agent injection control device is configured, such that the reducing agent for preventing clogging from the reducing agent feed valve is injected, when a calculated degree of adherence of soot reaches a limit of an allowable adherence degree during the period of suspension of the injection control for exhaust treatment, before the feed of fuel to the combustion chamber is stopped, and wherein the reducing agent injection control device is configured to calculate the degree of adherence based on an amount of soot deposited when the reducing agent is injected from the reducing agent feed valve, a temperature representing a temperature of an inside wall surface of the nozzle hole of the reducing agent feed valve, and an elapsed time period after injection from the reducing agent feed valve is stopped.

* * * * *